US011781405B2

(12) United States Patent
Jaure et al.

(10) Patent No.: US 11,781,405 B2
(45) Date of Patent: Oct. 10, 2023

(54) ACOUSTIC WELLBORE DELIQUIFICATION

(71) Applicant: Chevron U.S.A. Inc., San Ramon, CA (US)

(72) Inventors: Greg Richard Jaure, Albuquerque, NM (US); Cole Thomas Brinkley, Los Lunas, NM (US); Farid George Mitri, Santa Fe, NM (US); Jonathon Crain Boudreaux, Santa Fe, NM (US); James Thomas Stiernberg, Pearland, TX (US); Dennis John Harris, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 458 days.

(21) Appl. No.: 16/995,709

(22) Filed: Aug. 17, 2020

(65) Prior Publication Data

US 2021/0102447 A1 Apr. 8, 2021

Related U.S. Application Data

(60) Provisional application No. 62/909,630, filed on Oct. 2, 2019.

(51) Int. Cl.
*E21B 43/12* (2006.01)
*E21B 37/00* (2006.01)

(52) U.S. Cl.
CPC ..... *E21B 43/121* (2013.01); *E21B 37/00* (2013.01)

(58) Field of Classification Search
CPC ..... E21B 43/121; E21B 37/00
See application file for complete search history.

(56) References Cited

U.S. PATENT DOCUMENTS

| | | | | |
|---|---|---|---|---|
| 5,184,678 | A * | 2/1993 | Pechkov | E21B 43/003 166/177.2 |
| 6,429,575 | B1 * | 8/2002 | Abramov | B06B 3/00 310/337 |
| 9,664,016 | B2 * | 5/2017 | Harris | E21B 43/124 |
| 2011/0127031 | A1 * | 6/2011 | Zolezzi Garreton | E21B 28/00 166/249 |
| 2014/0262229 | A1 * | 9/2014 | Harris | E21B 43/121 166/177.6 |
| 2014/0262230 | A1 * | 9/2014 | Harris | E21B 43/124 166/65.1 |
| 2015/0240602 | A1 * | 8/2015 | Troshko | E21B 43/122 166/243 |
| 2018/0058191 | A1 * | 3/2018 | Romer | E21B 43/122 |
| 2018/0179873 | A1 * | 6/2018 | Artinian | E21B 43/128 |

* cited by examiner

*Primary Examiner* — Blake Michener
*Assistant Examiner* — Neel Girish Patel
(74) *Attorney, Agent, or Firm* — Parul P. Anderson

(57) ABSTRACT

A method of deliquification of production wells includes placing an artificial lift tool in a gas wellbore, where the artificial lift tool includes a rack and multiple piezoelectric transducers. The rack includes multiple trays. Each piezoelectric transducer of the multiple piezoelectric transducers is positioned on a respective tray of the multiple trays. The method further includes providing, by a pump, a liquid on surfaces of the multiple piezoelectric transducers and providing, by a signal source, an electrical signal to the multiple piezoelectric transducers. The method also includes generating, by the multiple piezoelectric transducers, acoustic waves from the electrical signal, where at least some of the liquid provided to the multiple piezoelectric transducers is atomized by the acoustic waves.

13 Claims, 7 Drawing Sheets

ACOUSTIC WELLBORE DELIQUIFICATION

CROSS-REFERENCE TO RELATED APPLICATION

The present application claims the benefit of U.S. Provisional Patent Application No. 62/909,630 for "Acoustic Wellbore Deliquification" filed on Oct. 2, 2019, the entire content of which is hereby incorporated in by reference.

TECHNICAL FIELD

The present application is generally related to deliquification of natural gas production wells, and more particularly, to an acoustic artificial lifting of liquids for deliquification of natural gas production wells.

BACKGROUND

Natural gas production wells often include liquids such as water. During initial production operations, the reservoir typically has sufficient energy to force the liquids along with the gas to the surface through the production tubing. As the reservoir pressure declines over time, the liquids start accumulating at the bottom of the gas production well because the natural reservoir pressure is unable to force all of the liquids to the surface. As the liquid column increases at the bottom of the gas production well, the liquids start suppressing the gas production rate of the well fluid and may eventually cause the gas production of the well to stop. Thus, a solution that enables removing liquids from a gas production well to avoid excessive accumulation of liquids (i.e., a liquid column) at the bottom of the well may be desirable.

SUMMARY

The present application is generally related to deliquification/dewatering of natural gas production wells, and more particularly, to an acoustic artificial lifting of liquids for deliquification/dewatering of natural gas production wells. In an example embodiment, a method of deliquification of production wells includes placing an artificial lift tool in a gas wellbore, where the artificial lift tool includes a rack and multiple piezoelectric transducers. The rack includes multiple trays. Each piezoelectric transducer of the multiple piezoelectric transducers is positioned on a respective tray of the multiple trays. The method further includes providing, by a pump, a liquid on surfaces of the multiple piezoelectric transducers and providing, by a signal source, an electrical signal to the multiple piezoelectric transducers. The method also includes generating, by the multiple piezoelectric transducers, acoustic waves from the electrical signal, where at least some of the liquid provided to the multiple piezoelectric transducers is atomized by the acoustic waves.

In another example embodiment, an artificial lift tool includes a rack comprising multiple trays and multiple piezoelectric transducers. Each piezoelectric transducer of the multiple piezoelectric transducers is positioned on a respective tray of the multiple trays. The artificial lift tool further includes a tubing to carry a liquid to the multiple piezoelectric transducers and a wiring to provide an electrical signal to the multiple piezoelectric transducers. The multiple piezoelectric transducers are configured to generate sound waves from the electrical signal.

In yet another example embodiment, an artificial lift system includes a pump and a piping to carry a liquid pumped by the pump. The artificial lift system further includes an artificial lift tool that includes a rack, the rack including multiple trays, wherein each piezoelectric transducer of the multiple piezoelectric transducers is positioned on a respective tray of the multiple trays. The artificial lift tool further includes a tubing coupled to the piping to carry the liquid to the multiple piezoelectric transducers and a wiring to carry an electrical signal to the multiple piezoelectric transducers. The multiple piezoelectric transducers are configured to generate sound waves from the electrical signal.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
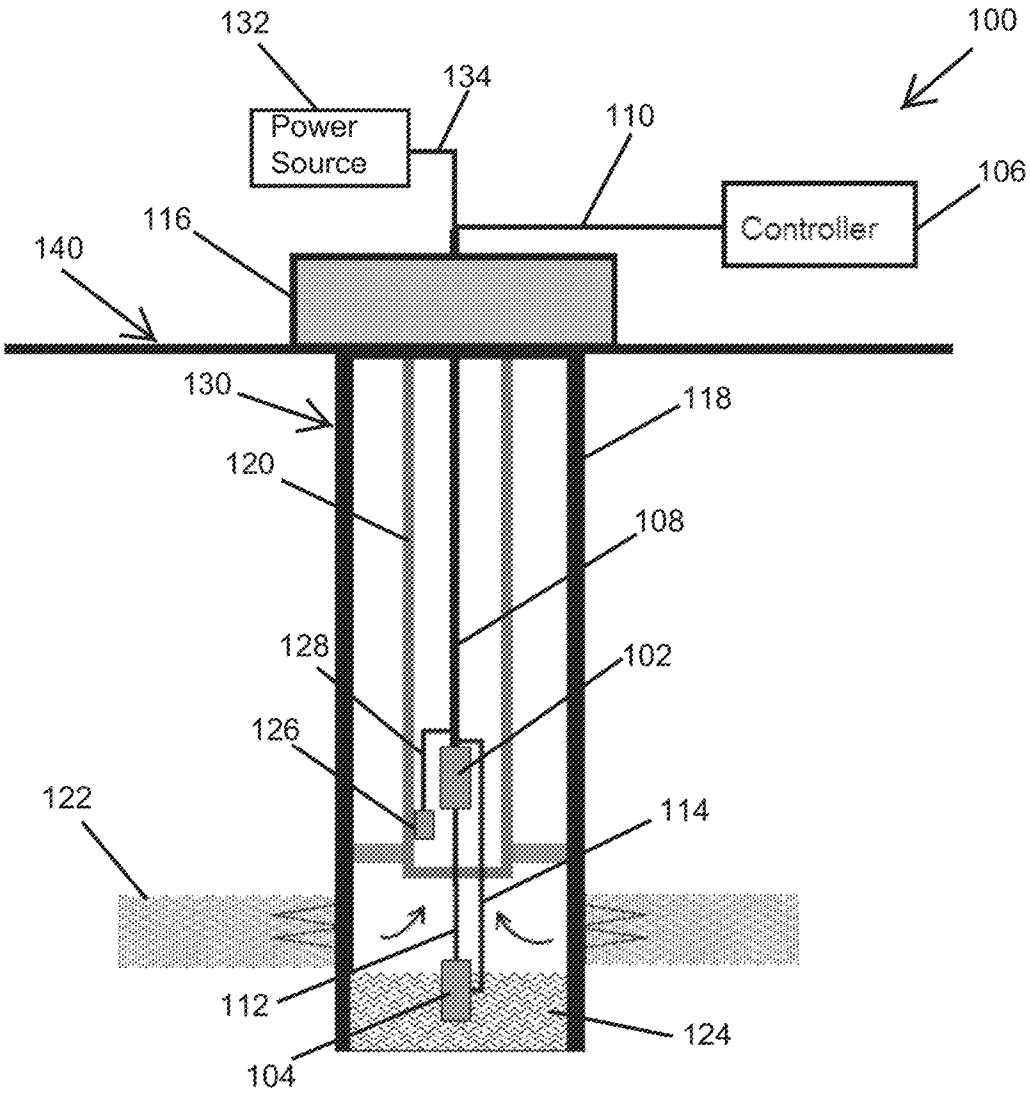
FIG. 1 illustrates an artificial lift system including an artificial lift tool according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in different drawings may designate like or corresponding but not necessarily identical elements.

DETAILED DESCRIPTION OF THE EXAMPLE EMBODIMENTS

In the following paragraphs, particular embodiments will be described in further detail by way of example with reference to the drawings. In the description, well-known components, methods, and/or processing techniques are omitted or briefly described. Furthermore, reference to various feature(s) of the embodiments is not to suggest that all embodiments must include the referenced feature(s).

Gas wells begin loading up with liquid when the reservoir pressure declines to a point that the natural flow of gas into the well is no longer capable of carrying the droplets of fluid to the surface. This leads to the accumulation of a liquid column, which adds to the hydrostatic back pressure experienced at the bottom of the well where hydrocarbon fluids enter the wellbore from the reservoir. One of the key aspects controlling the unloading of liquid (e.g., water) from a well is the size of fluid droplets entrained in the gas stream.

In some cases, the back pressure exerted by accumulated liquids in the well may be reduced by breaking up the liquid phase into smaller, more easily transported droplets. In some example embodiments, acoustic energy may be used to deliquefy/dewater a natural gas wellbore. To illustrate, a power unit on the surface can send electrical power to a downhole acoustic tool (i.e., an artificial lift tool) suspended in the wellbore by a winch and a conductive cable. The downhole acoustic tool converts the electrical power to acoustic energy, which in turn converts liquid in the wellbore to a mist that is more transportable by the natural gas moving upward toward the surface through the production tube.

For example, an artificial lift tool may include one or more electricity-to-sound transducers, such as piezoelectric transducers, that are placed in a respective tray that has a diameter of, for example, one or more inches. A number of trays that each carry a transducer may be attached to support struts vertically spaced from each other, for example, by one or more inches. The tool operates by liquid filling the trays to cover the transducers. When electrical voltage is applied to the transducers, the transducers vibrate and atomize the liquid into a mist. The resulting mist rises and is then carried up the production tubing by the flow of gas or air. The bottom surface of the trays may have a parabolic shape, a convex shape, or another suitable shape to deflect/direct the rising mist toward the path of the flow of gas or air and to provide a coalescing site for droplets adhering to the sides and bottoms of the trays.

Turning to the drawings, FIG. 1 illustrates an artificial lift system 100 including an artificial lift tool 102 according to an example embodiment. In some example embodiments, the system 100 includes the artificial lift tool 102, a pump 104, and a controller 106. The artificial lift tool 102 is designed to convert a liquid into mist/droplets. As used herein, the term "atomize" and its variations refer to the act or process of converting liquid into mist/droplets.

In some example embodiments, the artificial lift tool 102 and the pump 104 may be lowered into a wellbore 130 through a production tubing 120. For example, the wellbore 130 may include a casing 118, and the production tubing 120 may extend down into the casing 118. Alternatively, the casing 118 may be omitted without departing from the scope of this disclosure. The artificial lift tool 102 and the pump 104 may be suspended in the wellbore 130 by a wireline 108 extending down from the ground level/surface 140, where a wellhead 116 and the controller 106 are located.

In some example embodiments, the wireline 108 may include electrical connections (e.g., one or more wires) 110, 134. For example, the electrical connection 110 may include one or more electrical wires to carry an electrical signal from the controller 106 to the artificial lift tool 102. To illustrate, the controller 106 may operate as or may include a signal source that provides/generates an electrical signal having a particular frequency (e.g., in hundreds of KHz or in MHz ranges) set by an operator. The electrical connection 110 may also include one or more electrical wires coupled to a power unit 132 that can provide power to the pump 104 and to other components in the wellbore 130 via the electrical connection 110. In some alternative embodiments, the artificial lift tool 102 may include a driver circuit (e.g., a driver circuit 228 shown in FIG. 2), and the controller 106 or the power unit 132 may provide electrical power (e.g., direct current (DC) power or alternative current (AC) power) to the driver circuit via the wireline 108. The driver circuit may generate an electrical signal from the received electrical power and provide the electrical signal to the transducers (e.g., the piezoelectric transducers 216, 218 shown in FIG. 2) of the artificial lift tool 102, which causes the transducers to resonate at their natural frequencies.

In some example embodiments, the system 100 includes piping 112 that carries a liquid pumped by the pump 104 to the artificial lift tool 102. The system 100 may also include an electrical cable 114 (e.g., one or more electrical wires) to branch off the wireline 108, where power from the power unit 132 is provided to the pump 104 via the electrical cable 114. In some example embodiments, the piping 112 and the electrical cable 114 may be routed together (e.g., through a larger piping) between the artificial lift tool 102 and the pump 104 without departing from the scope of this disclosure.

In some example embodiments, the pump 104 is placed in the wellbore 130 such that the pump 104 is at least partially positioned in a liquid column 124 close to the bottom of the wellbore 130. The artificial lift tool 102 is placed in the wellbore 130 such that the artificial lift tool 102 is located in the production tube 120 and above the liquid column 124.

In some example embodiments, the system 100 may include one or more sensors 126 that sense wellbore parameters such as temperature, pressure, etc. For example, the one or more sensors 126 may transmit the measured parameters to the controller 106 via an electrical cable 128 that is electrically coupled to the controller 106 via the wireline 108. The controller 106 may process the information from the one or more sensors 126 to determine the location of the surface of the liquid column 124. In general, the controller 106 may determine the location of the surface of the liquid column 124 in a manner described in U.S. Pat. No. 9,664,016, which is incorporated herein in its entirety by reference. Alternatively, the controller 106 may determine the location of the surface of the liquid column 124 using other means known to those of ordinary skill in the art with the benefit of this disclosure. By determining the location of the liquid column 124, the controller 106 may enable the positioning of the pump 104 in the liquid column 124 and the positioning of the artificial lift tool 102 in the production tubing 120 and above the liquid column 124.

In some example embodiments, the artificial lift tool 102 may atomize the liquid provided by the pump 104. As described in more detail below, the artificial lift tool 102 includes multiple transducers, such as piezoelectric transducers, that generate acoustic waves from the electrical signal provided by the controller 106. For example, the electrical signal provided by the controller 106 may have a frequency in the range between 1 MHz and 2 MHz. Alternatively, the frequency of the electrical signal may be higher or lower than the range of 1 MHz to 2 MHz. The acoustic waves generated by the piezoelectric transducers cause at least some of the liquid to turn into mist, where the mist is carried upward toward the surface 140 through the production tubing 120.

To illustrate, natural gas may enter into the wellbore 130 from the reservoir 122 through perforations in the casing 118 and travel upward into the production tubing 120 as shown in FIG. 1 by the curved arrows. For example, the pressure in the reservoir 122 may force the natural gas to enter into the wellbore 130 and travel upward into the production tubing 120. As the gas travels through the production tubing 120 toward the ground level, the mist produced by the artificial lift tool 102 is carried upward to the ground level by the gas. By converting the liquid pumped by the pump 104 into mist that is transported to the surface 140 by the natural gas, the system 100 including the artificial lift tool 102 may prevent excessive liquid build up. The system 100 may also be used to perform the deliquification of the wellbore 130, for example, if excessive liquid has already accumulated in the wellbore 130.

In some alternative embodiments, the system 100 may include other components without departing from the scope of this disclosure. In some alternative embodiments, the one or more sensors 126 may be omitted without departing from the scope of this disclosure. In some alternative embodiments, the artificial lift tool 102 and the pump 104 as well as other components of the system 100 may be at different locations in the wellbore than shown in FIG. 1 without departing from the scope of this disclosure. In some alternative embodiments, the pump 104 may be fully submerged in the liquid column 124 without departing from the scope of this disclosure.

Figure 2:
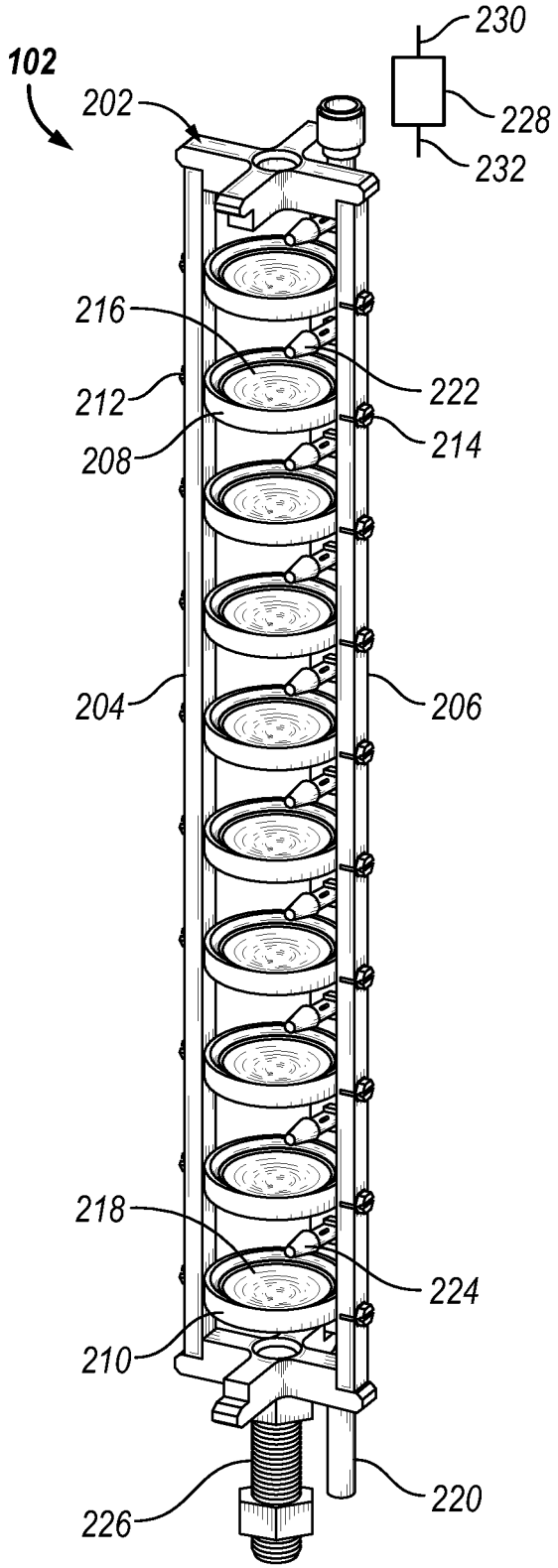
FIG. 2 illustrates the artificial lift tool of FIG. 1 according to an example embodiment.
Figure 4:
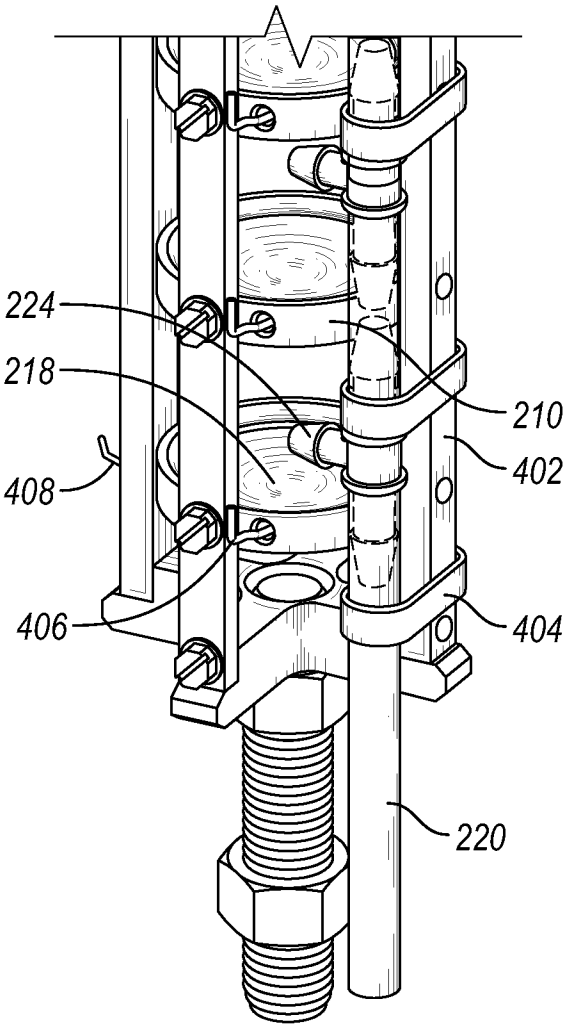
FIG. 4 illustrates a close-up view of a bottom portion of the artificial lift tool of FIG. 2 according to an example embodiment.
Figure 3:
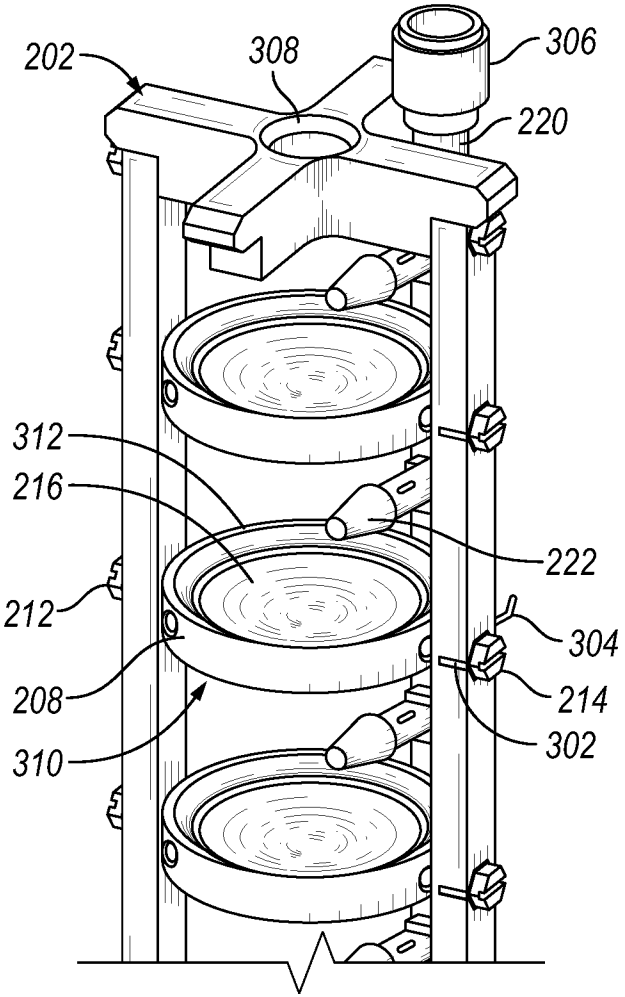
FIG. 3 illustrates a close-up view of a top portion of the artificial lift tool of FIG. 2 according to an example embodiment.

FIG. 2 illustrates the artificial lift tool 102 of FIG. 1 according to an example embodiment. FIG. 3 illustrates a close-up view of a top portion of the artificial lift tool 102 of FIG. 2 according to an example embodiment. FIG. 4 illustrates a close-up view of a bottom portion of the artificial lift tool 102 of FIG. 2 according to an example embodiment. Referring to FIGS. 1-4, in some example embodiments, the artificial lift tool 102 includes a rack 202 and multiple piezoelectric transducers including piezoelectric transducers 216, 218. The rack 202 includes multiple trays including trays 208 and 210 that are designed to hold the piezoelectric transducer 216 and 218, respectively. For example, the trays may hold the piezoelectric transducers such that broad surfaces of the piezoelectric transducers are substantially horizontal.

In some example embodiments, the rack 202 also includes support struts 204, 206, 402. For example, the individual trays of the rack 202 may be securely attached to the support struts 204, 206 by respective one or more fasteners. To illustrate with respect to the tray 208, a fastener 212 may extend through the support column 204 and the tray 208, and the fastener 214 may extend through the support column 206 and the tray 208, thereby securely attaching the tray 208 to the support strut 204. The other trays of the rack 202 may be attached to the struts 204, 206 by one or more fasteners in a similar manner.

In some example embodiments, the artificial lift tool 102 includes a tubing 220 designed to attach to the piping 112 of the system 100. For example, the tubing 220 may be attached to the support struct 402. The tubing 220 is designed to carry liquid to the piezoelectric transducers of the artificial lift tool 102. To illustrate, the tubing 220 may include outlet ports that are positioned to provide a liquid onto the piezoelectric transducers of the artificial lift tool 102. For example, the tubing 220 may include outlet ports 222, 224, where the outlet port 222 is positioned above the piezoelectric transducer 216 and where the outlet port 224 is positioned above the piezoelectric transducer 218. To illustrate, the outlet port 222 may be positioned to provide a liquid onto the upward-facing surface of the piezoelectric transducer 216. Similarly, the outlet port 224 may be positioned to provide a liquid onto the upward-facing surface of the piezoelectric transducer 218. For example, the pump 104 may pump adequate liquid from the liquid column 124 such that a layer of liquid (e.g., 1 mm or more) is formed on the surfaces of the piezoelectric transducers of the artificial lift tool 102. In some example embodiments, the tubing 220 may include an end cap to close off the tubing 220 at a top end of the artificial lift tool 102.

In some example embodiments, the artificial lift tool 102 includes wiring including one or more electrical wires that are attached to each piezoelectric transducer to provide an electrical signal to the particular piezoelectric transducer. As described above, the controller 106 may provide an electrical signal having a frequency in the range between 1 MHz and 2 MHz. Alternatively, the frequency of the electrical signal may be higher or lower the range of 1 MHz to 2 MHz.

In some alternative embodiments, the artificial lift tool 102 may include the driver circuit 228, and the controller 106 or the power unit 132 may provide electrical power (e.g., DC power or AC power) to the driver circuit 228 via the wireline 108. The driver circuit 228 may generate an electrical signal from the received electrical power and provide the electrical signal to the piezoelectric transducers of the artificial lift tool 102 including the piezoelectric transducers 216, 218, which causes the piezoelectric transducers to resonate at their natural frequencies. For example, the driver circuit 228 may be coupled to the wireline 108 via one or more electrical wires 230 and may be coupled to the piezoelectric transducers via one or more electrical wires 232. The wiring of the artificial lift tool 102 may include electrical wires 302, 304 that are routed through wireways in the tray 208 to the piezoelectric transducer 216. The electrical wire 302 may be a connected to the positive terminal of the piezoelectric transducer 216, and the electrical wire 304 may be a connected to the negative terminal of the piezoelectric transducer 216 as can be readily understood by those of ordinary skill in the art with the benefit of this disclosure. In some alternative embodiments, the wires 302, 304 may be routed to the piezoelectric transducer 216 through a common wireway. The electrical wires 302, 304 can be connected to the wireline 108 of the system 100 by an electrical cable (not shown) of the artificial lift tool 102 or by other means for the controller 106 to provide an electrical signal to the piezoelectric transducer 216.

As another example, the wiring of the artificial lift tool 102 may include electrical wires 406, 408 that are routed through wireways in the tray 210 to the piezoelectric transducer 218. The electrical wire 408 may be a connected to the positive terminal of the piezoelectric transducer 218, and the electrical wire 406 may be a connected to the negative terminal of the piezoelectric transducer 218 as can be readily understood by those of ordinary skill in the art with the benefit of this disclosure. In some alternative embodiments, the wires 406, 408 may be routed to the piezoelectric transducer 218 through a common wireway. The electrical wires 406, 408 can be connected to the wireline 108 of the system 100 by an electrical cable (not shown) of the artificial lift tool 102 or by other means for the controller 106 to provide an electrical signal to the piezoelectric transducer 216.

In some example embodiments, the artificial lift tool 102 may include an extension rod 226 that is attached to the rack 202 and that may be used to attach the rack 202 to another rack such as another rack 202. For example, the rack 202 may include an attachment hole 308 for attaching the extension rod 226 of another rack 202. To illustrate, attaching multiple racks, such as multiple ones of the rack 202, using the extension rod 226 and the attachment hole 308 may allow the artificial lift tool 102 to have more piezoelectric transducers without increasing the length of the individual rack 202. In some example embodiments, the end cap 306 may be removed such that the tubing 220 is fluidly coupled to a tubing of a second rack 202 for the liquid pumped by the pump 104 to reach the piezoelectric transducers of the second rack 202. In some example embodiments, the attachment hole 308 is used to suspend the artificial lift tool 102 in the production tubing 120 by the wireline 108.

In some example embodiments, the diameter of each tray of the rack 202 may be less than 1 inch. Alternatively, the diameter may be one inch or larger. For example, the diameter may be more than 1 inch and less than two inches. In some example embodiments, the trays may be vertically separated from each other by less than two inches. For example, the trays may be vertically separated from each other by 1 inch or less. Alternatively, the trays may be vertically separated from each other by two or more inches. In some example embodiments, the bottom surface of the trays of the rack 202, such as the bottom surface 310 of the tray 208, may be flat, parabolic, convex-shaped, or another suitable shape to deflect the mist generated by the activity of an immediately below piezoelectric transducers toward the path of the flow of gas flowing upward toward the surface. For example, the bottom surface 310 may provide a common point for droplets running down the sides of the tray 208 to coalesce.

In some example embodiments, the piezoelectric transducers of the artificial lift tool 102 may be flush with, slightly lower, or slightly higher than the perimeter edge of the trays holding the piezoelectric transducers. To illustrate with respect to the tray 218, the upward-facing surface of the piezoelectric transducer 216 may be flush with, slightly lower (e.g., a few millimeters), or slightly higher (e.g., a few millimeters) than the perimeter edge 312 of the tray 208. For example, in some applications, the perimeter edge 312 of the tray 208 may allow more of the mist generated by the piezoelectric transducer 216 to travel into the path of the gas traveling toward the surface 140.

During operations, the artificial lift tool 102 may atomize the liquid provided by the pump 104. To illustrate, the liquid pumped by the pump 104 may be provided onto the upward-facing surfaces of the piezoelectric transducers, including the piezoelectric transducers 216, 218, through the tubing 220. The piezoelectric transducers receive an electrical signal from the controller 106 via the wireline and the respective electrical wires, such as the wires 302, 304 and 406, 408, and generate ultrasonic acoustic waves from the electrical signal. The acoustic waves turn at least some of the liquid provided onto the piezoelectric transducers into mist that is carried upward toward the surface 140 through the production tubing 120 by the natural gas flowing upward toward the surface 140. By converting the liquid pumped by the pump 104 into mist that is transported to the surface 140 by the natural gas, the artificial lift tool 102 may prevent excessive liquid build up. The artificial lift tool 102 may be used to perform the deliquification of the wellbore 130, for example, if excessive liquid has already accumulated in the wellbore 130.

In some example embodiments, the rack 202 and other components of the artificial lift tool 102 may be made from a material suitable for use in a natural gas wellbore. To illustrate, the artificial lift tool 102 may be intended for use in a wellbore with a temperature of approximately 300 degrees F. For example, the rack 202 may be made mostly from a metal such as steel.

In some alternative embodiments, the artificial lift tool 102 may include more or fewer trays and corresponding piezoelectric transducers than shown in FIG. 2 without departing from the scope of this disclosure. In some alternative embodiments, the trays may be attached to the struts by other means without departing from the scope of this disclosure. In some alternative embodiments, the trays, the piezoelectric transducers, the tubing including the outlet ports may have a different shape than shown without departing from the scope of this disclosure.

Figure 5:
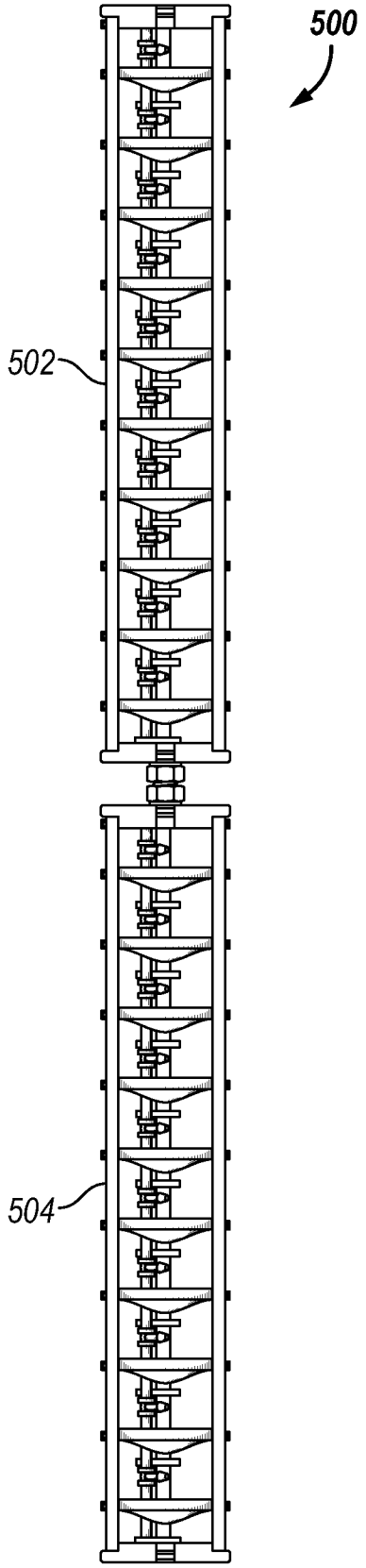
FIG. 5 illustrates an artificial lift tool for use in the artificial lift system of FIG. 1 according to another example embodiment.

FIG. 5 illustrates an artificial lift tool 500 for use in the artificial lift system 100 of FIG. 1 according to another example embodiment. Referring to FIGS. 1-5, in some example embodiments, the artificial lift tool 500 includes two racks 502, 504 that each correspond to the rack 202 more clearly shown in FIGS. 2-4. To illustrate, the two racks 502, 504 may be attached serially to each other by the extension rod 226 of the rack 502 that is inserted in the attachment hole 308 of the rack 504. Alternatively, the racks 502, 504 may be serially connected to each other by other means as can be readily understood by those of ordinary skill in the art with the benefit of this disclosure.

In some example embodiments, the tubing 220 of the racks 502, 504 that are used to carry a liquid to the piezoelectric transducers of the artificial lift tool 500 may be joined directly to each other or by a connector tube. For example, the end cap 306 more clearly shown in FIG. 3 may be removed. After the flow path is established between the tubing 220 of the racks 502, 504, the liquid provided by the pump 104 may first flow to the tubing 220 of the rack 504 and continue to flow to the tubing 220 of the rack 502. The artificial lift tool 500 allows the use of multiple racks to achieve a higher conversion rate of liquid to mist. In some alternative embodiments, the artificial lift tool 500 may include more than two racks. In some alternative embodiments, one or both of the racks 502, 504 may correspond to a rack that has more or fewer trays than shown without departing from the scope of this disclosure.

Figure 6:
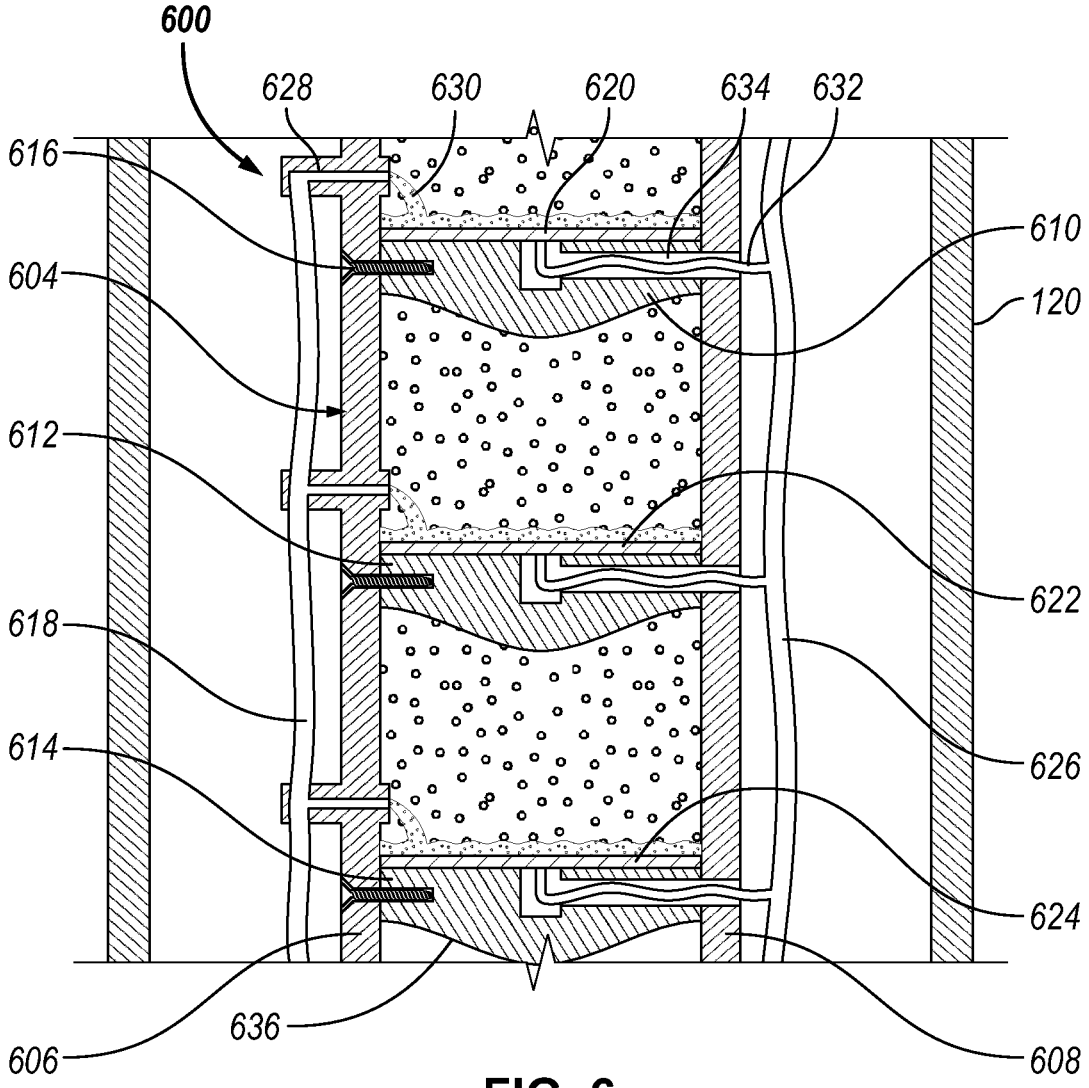
FIG. 6 illustrates a cross-sectional view of an artificial lift tool for use in the artificial lift system of FIG. 1 according to an example embodiment.

FIG. 6 illustrates a cross-sectional view of an artificial lift tool 600 for use in the artificial lift system 100 of FIG. 1 according to an example embodiment. In some example embodiments, the artificial lift tool 600 may be used in the system 100 of FIG. 1 instead of the artificial lift tool 102. Referring to FIGS. 1 and 6, in some example embodiments, the artificial lift tool 600 includes a rack 604 that includes at least two struts 606, 608 and trays 610, 612, 614. The trays 610-614 may be securely attached to the struts by one or more fasteners. For example, the tray 610 may be attached to the strut 606 by a fastener 616. The tray 610 may also be attached to another strut of the rack 604 by another fastener.

In some example embodiments, the artificial lift tool 600 may include piezoelectric transducers 620, 622, 624. The piezoelectric transducer 620 may be positioned on the tray 610. The piezoelectric transducer 622 may be positioned on the tray 612. The piezoelectric transducer 624 may be positioned on the tray 614. The artificial lift tool 600 may include tubing 618 for providing onto the piezoelectric transducers 620, 622, 624 the liquid that is pumped to the artificial lift tool 600, for example, by the pump 104. To illustrate, the tubing 618 may include output ports positioned to provide liquid onto the upward-facing surface of each piezoelectric transducer 620, 622, 624.

For example, an output port 628 of the tubing 618 may provide the liquid onto the piezoelectric transducer 620. For example, the flow rate of the liquid may be such that a liquid layer is formed on the upward-facing surface of the piezoelectric transducer 620.

In some example embodiments, the artificial lift tool 600 may include wiring 626 to carry an electrical signal to the piezoelectric transducers 620, 622, 624. For example, the wiring 626 may be coupled to the wireline 108 that carries the electrical signal from the controller 106 or another signal source. The wiring 626 may include electrical wires, such as an electrical wire 632, that are routed through wireways in the trays 610, 612, 614. For example, the electrical wire 632 may be routed through a wireway 634 in the tray 610. The controller 106 or another signal source may provide an electrical signal to the piezoelectric transducers 620, 622, 624, via the wireline 108 and the wiring 626, and the piezoelectric transducers 620, 622, 624 may generate ultrasonic acoustic waves that convert at least some of the liquid provided via the tubing 618 into mist. For example, the electrical signal may have a frequency in the range between 1 MHz and 2 MHz. Alternatively, the frequency of the electrical signal may be higher or lower the range of 1 MHz to 2 MHz.

In some alternative embodiments, the artificial lift tool 600 may include a driver circuit (e.g., the driver unit 228 shown in FIG. 2), and the controller 106 or the power unit 132 may provide electrical power (e.g., DC power or AC power) to the driver circuit via the wireline 108. The driver circuit may generate an electrical signal from the received electrical power and provide the electrical signal to the piezoelectric transducers 620, 622, 624, which causes the piezoelectric transducers 620, 622, 624 to resonate at their natural frequencies.

In some example embodiments, the mist generated by the acoustic waves may be deflected/directed by the bottom surfaces of the trays toward the path of the natural gas flowing upward through the production tubing 120 toward the ground level. In some example embodiments, the trays 610-614 may be vertically separated from each other by less than 2 inches. For example, the trays 610-614 may be vertically separated by about one inch. In some example embodiments, each tray 610-614 may have a diameter of less than 2 inches. For example, each tray 610-614 may have a diameter one inch. In some example embodiments, the bottom surfaces of the trays 610-614, such as the bottom surface 636 of the tray 614, may have a parabolic shape, a convex shape, or another suitable shape to deflect/direct the rising mist toward the path of the natural gas flowing upward in the production tubing 120. In some example embodiments, the bottom surface of each tray 610-614 may provide a common point for droplets running down the sides of the trays 610-614 to coalesce.

In some alternative embodiments, the artificial lift tool 600 may include more or fewer piezoelectric transducers than shown without departing from the scope of this disclosure.

Figure 7:
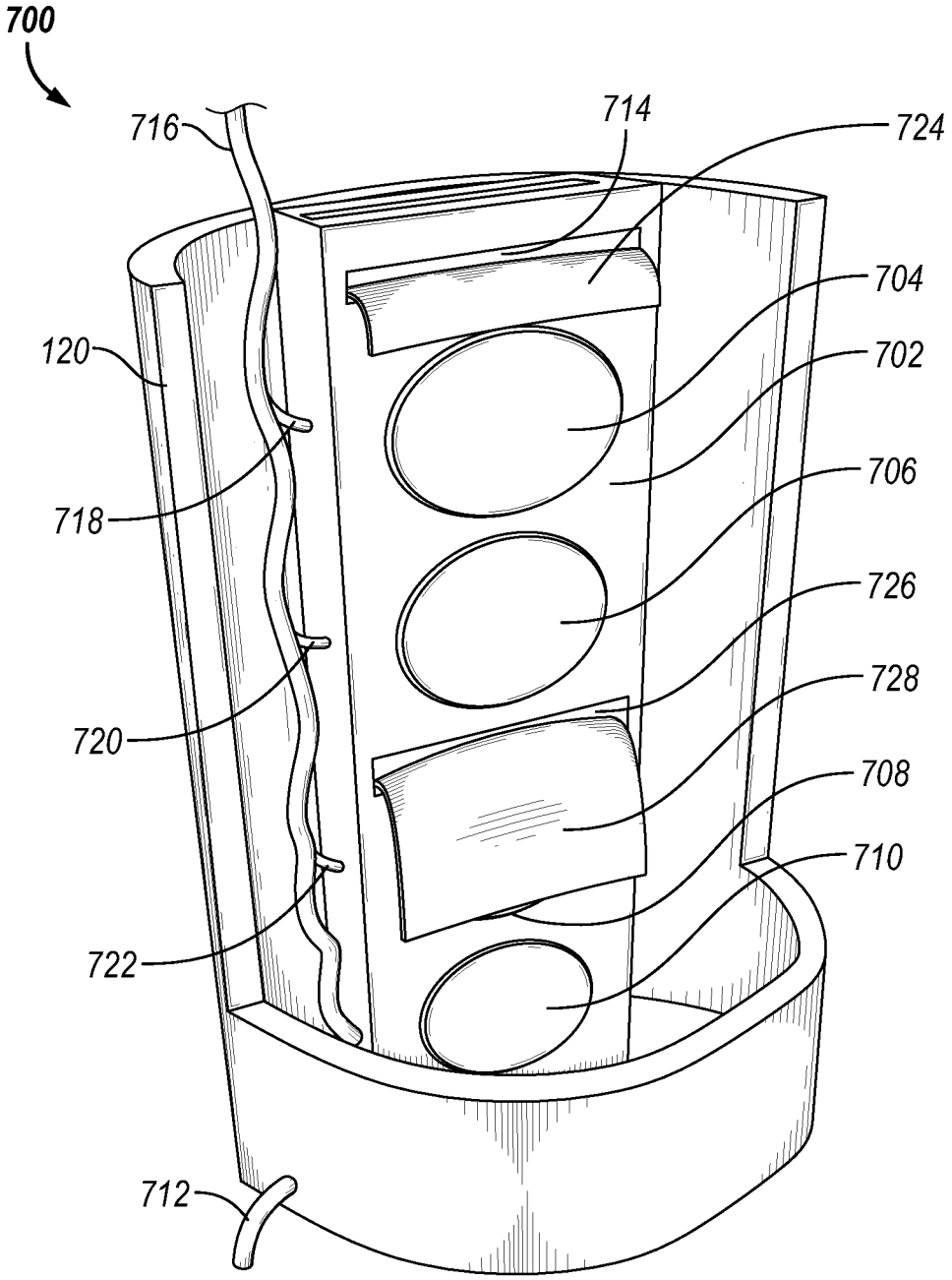
FIG. 7 illustrates an artificial lift tool for use in the artificial lift system of FIG. 1 according to another example embodiment.

FIG. 7 illustrates an artificial lift tool 700 for use in the artificial lift system 100 of FIG. 1 according to another example embodiment. Referring to FIGS. 1 and 7, in some example embodiments, the artificial lift tool 700 includes a frame 702 and piezoelectric transducers 704-710. The artificial lift tool 700 may also include tubing 712 that is used to provide liquid to the piezoelectric transducers 704-710. For example, the tubing 712 may be connected to the piping 112 of the system 100. The tubing 712 may be routed to a first liquid opening 714 in the frame 702 above all of the piezoelectric transducers 704-710 and to a second liquid opening 726 in the frame 702 above the piezoelectric transducers 708, 710.

In some example embodiments, the artificial lift tool 700 may include wiring 716 to carry an electrical signal to the piezoelectric transducers 704-710. For example, the wiring 716 may be coupled to the wireline 108 that carries the electrical signal from the controller 106 or another signal source. The wiring 716 may include electrical wires 718, 720, 722 that are connected to the piezoelectric transducers 704, 706, 708, respectively. For example, the electrical wires 718-722 may be routed to the piezoelectric transducers 704-708 through wireways in the frame 702. The controller 106 or another signal source may provide the electrical signal to the piezoelectric transducers 704-710, via the wireline 108 and the wiring 716, and the piezoelectric transducers 704-710 may generate ultrasonic acoustic waves that convert at least some of the liquid provided via the tubing 712 into mist. For example, the electrical signal may have a frequency in the range between 1 MHz and 2 MHz. Alternatively, the frequency of the electrical signal may be higher or lower the range of 1 MHz to 2 MHz.

In some alternative embodiments, the artificial lift tool 700 may include a driver circuit (e.g., the driver unit 228 shown in FIG. 2), and the controller 106 or the power unit 132 may provide electrical power (e.g., DC power or AC power) to the driver circuit via the wireline 108. The driver circuit may generate an electrical signal from the received electrical power and provide the electrical signal to the piezoelectric transducers 704-710, which causes the piezoelectric transducers 704-710 to resonate at their natural frequencies.

To illustrate, the piezoelectric transducers 704-710 are attached to the frame 702 such that broad sides of the piezoelectric transducers 704-710 are in a vertical orientation or a substantially vertical orientation. For example, the frame 702 and/or the piezoelectric transducers 704-710 may be slightly tilted (e.g., 15 degrees from a vertical axis) without departing from the scope of this disclosure. As shown in FIG. 7, the piezoelectric transducer 704 is immediately above the piezoelectric transducer 706 that is immediately above the piezoelectric transducer 708, which is immediately above the piezoelectric transducer 710. Some of the liquid provided by the pump 104 through piping 112 and the tubing 712 flows out through the first liquid opening 714 and may form a liquid curtain over the piezoelectric transducers 704-710. As the liquid 724 flows over the piezoelectric transducers 704-710, ultrasonic acoustic waves generated by the piezoelectric transducers 704-710 may cause some of the liquid 724 to turn into mist. Some of the liquid provided by the pump 104 also flows out through the second liquid opening 726 and may form a liquid curtain over the piezoelectric transducers 708, 710. As the liquid 728 flows over the piezoelectric transducers 708, 710, ultrasonic acoustic waves generated by the piezoelectric transducers 708, 710 may cause some of the liquid 728 to turn into mist. The mist generated by the piezoelectric transducers 704-710 may be carried upward through the production tubing 120 (shown in FIG. 7 partially for illustrative purposes) by the natural gas flowing upward to the ground level through the production tubing 120.

Because the broad sides of the piezoelectric transducers 704-710 are vertically oriented, the artificial lift tool 700 may take up a smaller horizontal cross-section of the production tubing 120 compared to the artificial lift tools 100, 500, 600, providing more space for the natural gas to flow upward to the ground level.

In some alternative embodiments, the artificial lift tool 700 may include more or fewer piezoelectric transducers than shown in FIG. 7 without departing from the scope of this disclosure. In some alternative embodiments, the frame 704 may include more or fewer liquid openings for providing liquid to the piezoelectric transducers.

Figure 8:
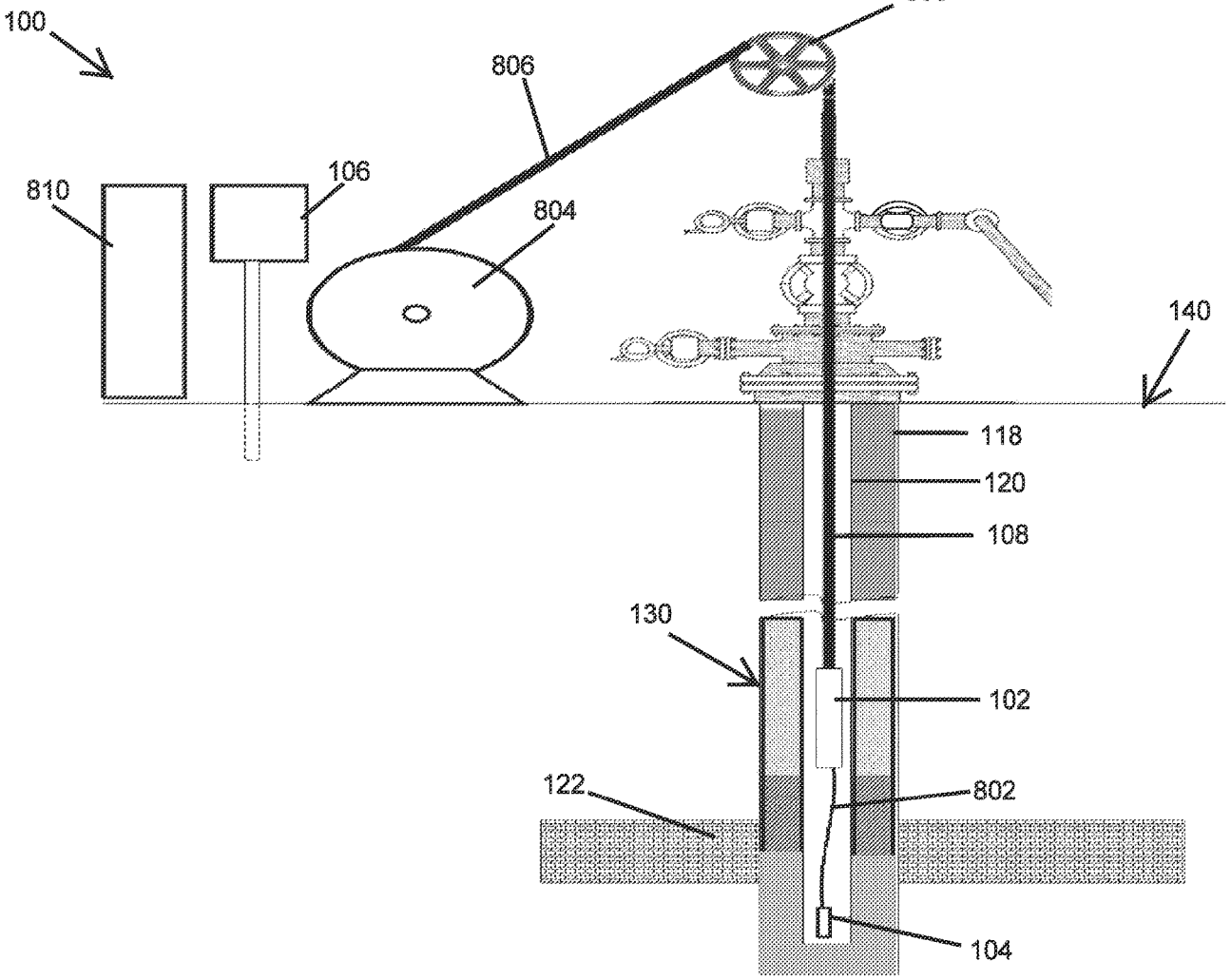
FIG. 8 illustrates the downhole tool system of FIG. 1 including additional system components according to an example embodiment.

FIG. 8 illustrates the downhole tool system 100 of FIG. 1 including additional system components according to an example embodiment. Referring to FIGS. 1-8, in some example embodiments, the controller 106 may control a winch system that includes a winch 804, a conductive cable 806, and a pulley 808 to raise and lower the artificial lift tool 102 in the wellbore 130. A power unit 810 that is located at the surface 140 may supply electrical power to the controller 106, the winch system, and pump 104 (e.g., a submersible micro pump).

The controller 106 sends an electrical signal to the artificial lift tool 102, particularly to the piezoelectric transducers of the artificial lift tool 102 via the conductive cable 806 that is connected to and/or included in the wireline 108 extending down into the production tubing 120. For example, an operator may configure the controller 106 such that the electrical signal provided by the controller 106 has a desired frequency (e.g., in KHz or MHz ranges) to enable the artificial lift tool 102 to produce mist from the liquid provided to the artificial lift tool 102 by the pump 104.

As described above, the artificial lift tool 102 is positioned above the liquid column 124 (shown in FIG. 1) at the bottom of the wellbore 130. For example, the controller 106 may determine the location of the top surface of the liquid column 124 based on information from one or more sensors in the wellbore 130 and may automatically control the positioning of the artificial lift tool 102 and the pump 104 by controlling the winch system. Alternatively, an operator may control the positioning of the artificial lift tool 102 and the pump 104 in the wellbore 130.

As described above, the mist generated by the artificial lift tool 102 from the liquid provided to the artificial lift tool 102 by the pump 104 may be moved to the surface by the gas flowing upward toward the surface. By converting the liquid into mist that can be removed by the natural gas that flows to the surface, the artificial lift system 100 and the artificial lift tool 102 enable the deliquification/dewatering of the wellbore 130, which can reduce the reduction and the risk of disruption of the production of natural gas from the reservoir 122.

In some alternative embodiments, the artificial lift tool 500, 600, or 700 may be used instead of the artificial lift tool 102 without departing from the scope of this disclosure. In some alternative embodiments, the system 100 may include other components than shown without departing from the scope of this disclosure.

Although some embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A method of deliquification of production wells, the method comprising:

placing an artificial lift tool in a gas wellbore, wherein the artificial lift tool comprises a rack and multiple piezoelectric transducers, wherein the rack comprises multiple trays, and wherein each piezoelectric transducer of the multiple piezoelectric transducers is positioned on a respective tray of the multiple trays;

placing a pump in the gas wellbore and providing electrical power to the pump;

providing, by the pump, a liquid on surfaces of the multiple piezoelectric transducers;

providing an electrical signal to the multiple piezoelectric transducers; and generating, by the multiple piezoelectric transducers, acoustic waves from the electrical signal, wherein at least some of the liquid provided to the multiple piezoelectric transducers is atomized by the acoustic waves.

2. The method of claim 1, wherein the pump in the gas wellbore is placed at least partially in a liquid column proximal to a bottom of the gas wellbore and wherein the pump provides the liquid to the multiple piezoelectric transducers via piping extending between the pump and the artificial lift tool.

3. The method of claim 2, wherein the piping is fluidly coupled to a tubing of the artificial lift tool that comprises multiple outlet ports that are each positioned above a respective piezoelectric transducer of the multiple piezoelectric transducers to provide the liquid on a surface of the respective piezoelectric transducer of the multiple piezoelectric transducers.

4. The method of claim 2, wherein the artificial lift tool is suspended in the gas wellbore by a wireline extending down from the ground level and wherein the artificial lift tool is suspended above a liquid column proximal to a bottom of the gas wellbore.

5. The method of claim 1, wherein the multiple trays are vertically separated from each other.

6. The method of claim 1, wherein the artificial lift tool comprises a driver circuit that generates the electrical signal from a direct current electrical power or an alternative current electrical power provided to the artificial lift tool and wherein the electrical signal is provided to the multiple piezoelectric transducers, and wherein the electrical signal causes the multiple piezoelectric transducers to vibrate at one or more natural frequencies of the multiple piezoelectric transducers.

7. An artificial lift tool, comprising:

a rack comprising multiple trays;

support struts, wherein the multiple trays are each attached to the support struts by one or more fasteners;

multiple piezoelectric transducers, wherein each piezoelectric transducer of the multiple piezoelectric transducers is positioned on a respective tray of the multiple trays;

a tubing to carry a liquid to the multiple piezoelectric transducers; and a wiring to provide an electrical signal to the multiple piezoelectric transducers, wherein the multiple piezoelectric transducers are configured to generate sound waves from the electrical signal.

8. The artificial lift tool of claim 7, wherein the tubing is attached to one of the support struts.

9. The artificial lift tool of claim 7, wherein the multiple trays are vertically separated from each other.

10. The artificial lift tool of claim 9, wherein the multiple trays are vertically separated from each other by less than 2 inches.

11. The artificial lift tool of claim 7, wherein the electrical signal has a frequency in a range of 1 MHz to 2 MHz.

12. The artificial lift tool of claim 7, wherein the wiring comprises electrical wires that extend through one or more wireways in each of the multiple trays to attach to the multiple piezoelectric transducers.

13. The artificial lift tool of claim 7, wherein the artificial lift tool comprises a driver circuit configured to generate the electrical signal from a direct current electrical power or an alternative current electrical power provided to the artificial lift tool and wherein the multiple piezoelectric transducers are configured to vibrate at one or more natural frequencies of the multiple piezoelectric transducers in response to the electrical signal.

* * * * *